United States Patent [19]

Hsu

[11] 4,146,367

[45] Mar. 27, 1979

[54] COAL DESULFURIZATION

[75] Inventor: George C. Hsu, La Crescenta, Calif.

[73] Assignee: California Institute of Technology, Pasadena, Calif.

[21] Appl. No.: 878,253

[22] Filed: Feb. 16, 1978

[51] Int. Cl.[2] ..... C10L 9/10; C10B 57/00

[52] U.S. Cl. ..... 44/1 R; 44/2; 201/17

[58] Field of Search ..... 44/1 R, 2; 201/17

[56] References Cited

U.S. PATENT DOCUMENTS 3,938,966 2/1976 Kindig et al. ..... 44/1 R

*Primary Examiner*—Carl Dees

*Attorney, Agent, or Firm*—Marvin E. Jacobs

[57] ABSTRACT

Organic sulfur is removed from coal by treatment with an organic solution of iron pentacarbonyl. Organic sulfur compounds can be removed by reaction of the iron pentacarbonyl with coal to generate CO and COS off-gases. The CO gas separated from COS can be passed over hot iron filings to generate iron pentacarbonyl.

11 Claims, 2 Drawing Figures

COAL DESULFURIZATION

ORIGIN OF THE INVENTION

The invention described herein was made in the performance of work under a NASA contract and is subject to the provisions of Section 305 of the National Aeronautics and Sapce Act of 1958, Public Law 83-568 (72 Stat. 435; 42 USC 2457).

BACKGROUND OF THE INVENTION

1. Field of the Invention

The present invention relates to coal desulfurization and, more particularly, to an improved coal pretreatment process for separating organic and inorganic sulfur components of coal.

2. Description of the Prior Art

The U.S. reserve of coal is about 3 trillion tons. Although the most abundant (80%) fossil fuel in America is coal, the U.S. consumption pattern is quite a reversal of form in terms of utilization, with coal representing only 17%, oil and gas about 78%.

The demand for all the fossil fuels combined is expected to double by the year 2000, even with the increasing use of nuclear power. While the domestic supply of crude oil and natural gas is not likely to keep apace with the energy demand, coal can play an important role in filling such a gap and thus reduce the requirements for imported supplies of oil and gas.

Coal, the fossilized plant life of prehistoric times, contains various amounts of sulfur due to the nature of its origin. Under most existing commercial technology, the generation of electricity from coal poses environmental problems because of sulfur oxides and particulate emissions. Since most of the coals in this country, particularly the Eastern and Midwestern coals, have high sulfur content (>2%) there is a need for an economical process of converting high sulfur coals to clean fuel (<1.2 lbs. of $SO_2$ emission per million BTU thermal output by EPA standard) to utilize coal as a source of energy without causing serious air pollution. So the need for converting massive coal reserves to clean-burning solid fuel, liquid fuel and pipeline quality gas is self evident. If the vast coal reserve is converted to clean fuel, it can supply most of the energy needs of the United States for the next three centuries.

At the present time, about one-half of the electric power in the United States is generated from natural gas and petroleum; most of the other half is from coal. If the coal is converted to clean fuel for electric utilities, petroleum and natural gas would be released for other essential uses, especially as a starting material for the synthetic rubber and plastics industry.

Sulfur in coal occurs in two types, generally in approximately equal amounts (50%): inorganic sulfur primarily as pyrites with minor amounts of sulfates and organic sulfur in the forms of thiophene, sulfide, disulfide and mercaptan chemically bound in the organic structure of coal.

Presently, sulfur is removed in post-combustion processes by stack gas scrubbing to remove sulfur oxides generated during combustion. However, the existing flue-gas desulfurization processes are expensive processes and produce large amounts of sludge. Physical separation methods only remove the inorganic sulfur components. Hydrodesulfurization processes which remove sulfur from the fuel before combustion are used extensively in petroleum desulfurization and are being considered in many coal conversion processes under development.

Hydrodesulfurization of coal requires large amounts of hydrogen and/or other raw material directly derived from petroleum, and requires large capital costs for equipment. Typically reactor temperatures are from 350 to 450° C., and pressures range from 1000 to 4000 PSIA when catalysts are employed, or even more drastic process conditions for non-catalytic systems. Even when reliable systems are achieved, the high temperatures required serve to maximize corrosion and as a result, process reactors require major overhaul every several months or at least once a year, depending on the severity of treating. A low temperature desulfurization process with minimum capital investment costs thus has long been desired.

SUMMARY OF THE INVENTION

An efficient and direct method of removing organic sulfur compounds from coal at low temperatures and pressure has been developed in accordance with this invention. The method utilizes readily available low cost reagents which can readily be recovered and recycled. Laboratory runs with high sulfur coals showed removal of about 80% by weight of the organic sulfur content which is the most difficult form of sulfur to remove from coal. The process may optionally be extended to remove inorganic pyrites and ash by thermal decomposition of the reagent to form a magnetic coating on the pyrites and fly ash. The coal pretreatment, especially with respect to the removal of organic sulfur, of the invention provides a superior coal beneficiating process.

In the process of the invention coal is slurried in organic solvent containing iron pentacarbonyl and heated to a temperature above 40° C. but less than 150° C. below the decomposition temperature of iron pentacarbonyl, generally from 70° C. to 100° C., depending on the reflux temperature of the solvent, for a time sufficient to dissolve a substantial portion (at least 50%) of the organic sulfur compounds, usually from 1 to 10 hours. The partially desulfurized coal is recovered by filtration or decantation and is dried. The solution of pentacarbonyl is distilled to recover solvent for recycle and iron pentacarbonyl can be decomposed at temperatures of at least 160° C.

The desulfurization method of this invention is based on a rather novel reaction of thiophene type compounds and $Fe(CO)_5$ identified in sulfur chemistry literature:

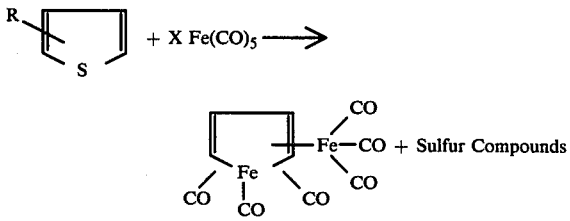

The sulfur containing compounds in the product have not been completely identified, but may include COS and compounds containing Fe and sulfur. When applied to coal desulfurization, this method appears to be selective towards the removal of organic sulfur, which is most difficult to remove. The partially desulfurized coal can be further beneficiated to remove inorganic sulfur by froth flotation or magnetic separation.

The process of the invention is readily adaptable to magnetic separation of ash and pyritic sulfur. A recent literature study under investigation indicates that iron carbonyl selectively associates with ash and pyrites and on heating the coal, the iron carbonyl thermally decomposes to selectively deposit a thin skin of magnetic material on the ash and pyrites while the other parts of coal particles are unaffected. After magnetic separation a non-magnetic coal low in inorganic sulfur and ash in produced.

The organic sulfur removal is a significant advantage of this process of invention. Being chemically bound to the organic structure of coal this sulfur is most difficult to remove without incurring high process cost.

This desulfurization process can be used as a pretreatment step before combustion or gasification. The processing scheme is simple and compatible with current coal processing technologies. Furthermore, no feeding or filtration problems are expected.

Since this coal desulfurization process is at atmospheric pressure and mostly at low temperature the process cost is expected to be lower than the process cost of other desulfurization schemes. The desulfurization process of this invention may also produce a porous treated coal material which is in a more reactive feedstock for combustion, gasification or liquefaction.

These and many other features and attendant advantages of the invention will become readily apparent as the invention becomes better understood by reference to the following detailed description when considered in conjunction with the accompanying drawings.

DESCRIPTION OF THE PREFERRED EMBODIMENTS

The desulfurization process is capable of desulfurizing diverse types of organic materials in addition to coal such as petroleum, oil shale or industrial wastes, particularly black liquor residues from sulfate or sulfite pulping. The coals can be anthracite, bituminous, subituminous or lignite. Pulverization aids slurrying and desulfurization rate. Typically the coal will be pulverized and classified to 60 to 325 mesh, usually from 100 to 200 mesh. The process is particularly designed to treat high sulfur coal containing at least 1% by weight of organic bound sulfur.

The organic solvent is a solvent for the iron carbonyl and sulfur reaction products and should have a low boiling point below 120° C., preferably from 40° C. to 100° C. so that it is refluxible at or near room temperature. Suitable solvents are aromatic hydrocarbons such as benzene, toluene or liquid coal distillates such as anthracene oils which are capable of penetrating and swelling coal so that the pentacarbonyl reagent can reach internal sulfur inclusions. The solvent is present is an amount sufficient to suspend the coal, generally 10 to 50% by weight of coal is added to the solvent. The amount of iron pentacarbonyl depends on the sulfur content of the coal. Generally an excess stoichiometric amount based on sulfur content of the coal is dissolved in the solvent. Adequate organic sulfur removal can be effected with iron pentacarbonyl solutions as low as 3% by weight. However, more efficient removal is achieved with solutions containing from 10 to 50% iron pentacarbonyl.

Figure 1:
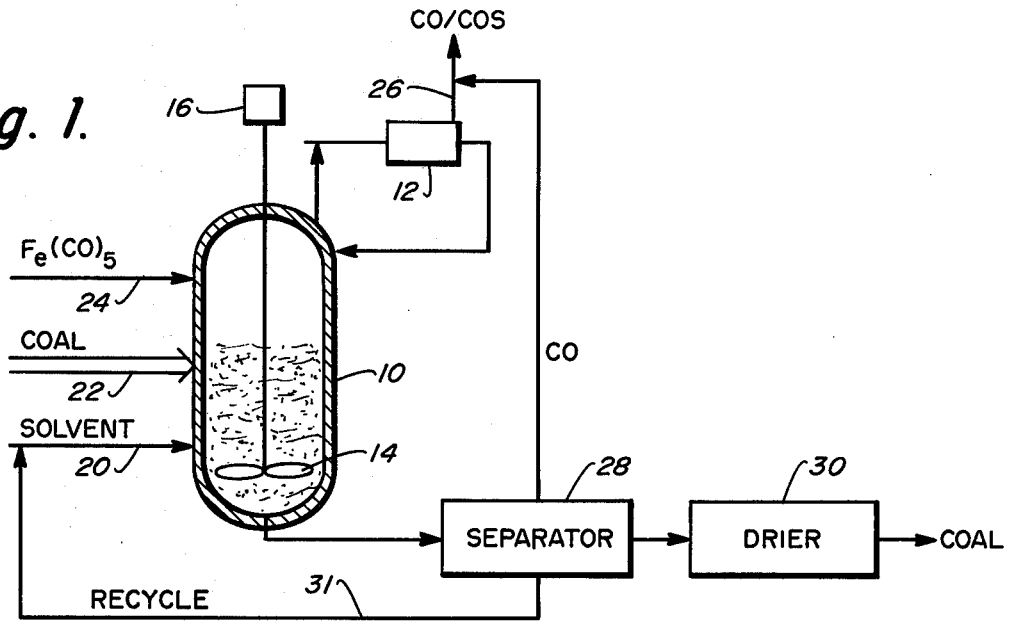
FIG. 1 is a block diagram view of the desulfurization system of this invention.

Referring now to FIG. 1, coal is desulfurized in a heated reactor 10 equipped with a reflux condenser 12 and stirrer 14 attached to motor 16. A slurry 18 is formed by feeding solvent, powdered coal and $Fe(CO)_5$ from inlets 20, 22, 24 respectively though the slurry can be formed outside of reactor 10 and fed as a single stream or the iron pentacarbonyl mixed in the solvent. At reaction temperature, the reflux solution reacts with bound organic sulfur and converts it to soluble derivatives which enter the solution including COS which is evolved from the reflux condenser 12 through outlet 26 along with some CO.

The slurry of treated coal is then processed through a separator 28 such as filter and the coal may then be dried in drier 30 before combustion, liquefaction or gasification or the slurry or wet product can be utilized directly. The solvent containing excess carbonyl can be recycled through line 31 directly to the reactor inlet 20 or heated to a temperature above 160° C. to decompose the carbonyl before recycle.

Figure 2:
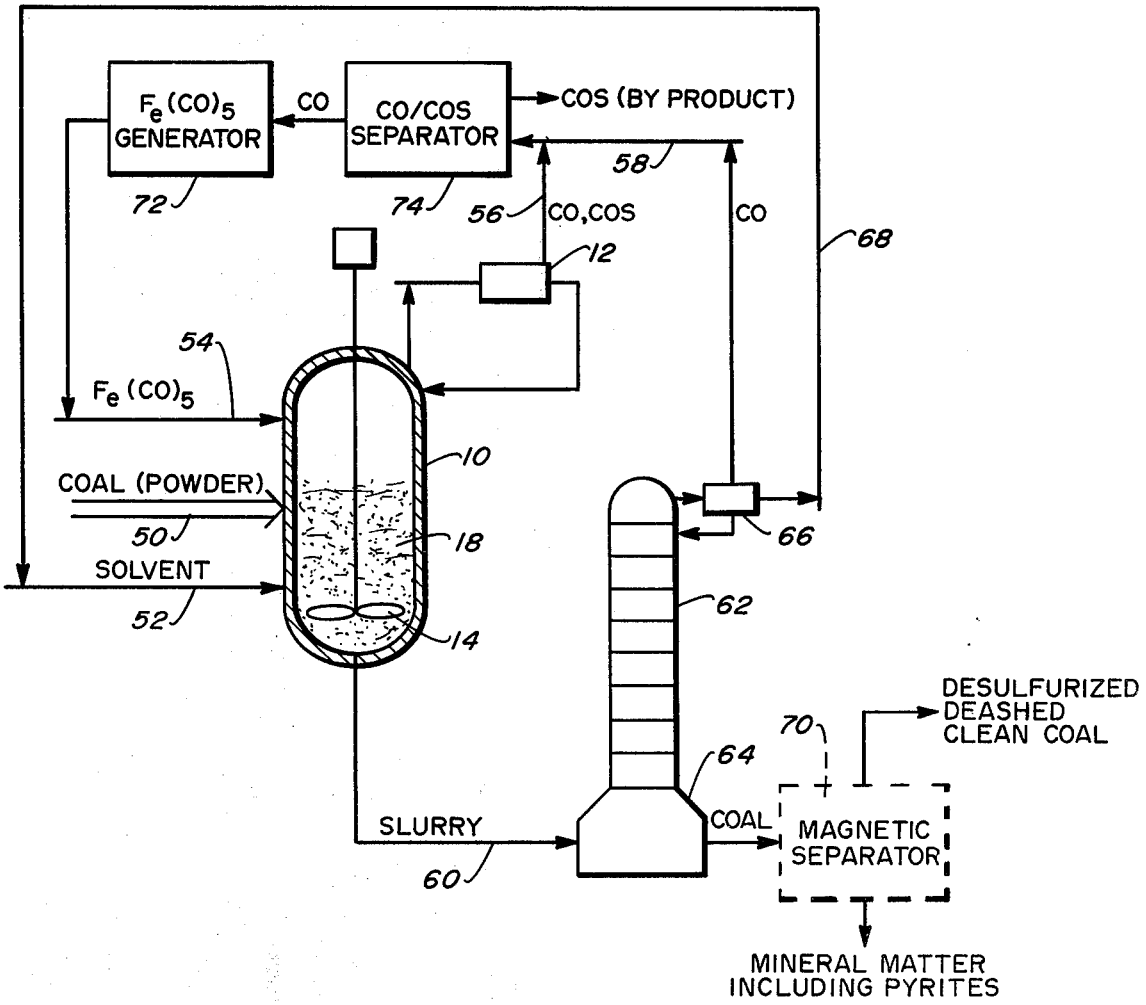
FIG. 2 is a schematic view of a more detailed desulfurization system of the invention.

A more complete organic-inorganic desulfurization system is illustrated in FIG. 2. The heated and stirred reactor 10 is fed coal through line 50, benzene-like solvent through line 52 and iron pentacarbonyl through line 54. During treatment at 70° C. and 1 atmosphere pressure for about 6 hours, CO and COS gases are removed from the reflux condenser 12 through line 56 which joins recycle conduit 58 to be described later.

The slurry 18 is delivered through line 60 to a distillation column 62 equipped with a reboiler 64. The slurry is heated in the reboiler to 160° C. to decompose unreacted iron pentacarbonyl into iron and CO. The benzene distills at 80° C. and is recovered in condenser 66 and recycled to inlet line 52 through recycle line 68. The CO is recovered from the condenser through recycle conduit 58. The iron selectively deposits pyritic sulfur to form a thin skin of magnetic material on the ash and pyritic sulfur but not on the ash.

The magnetic iron coated mineral matter is then removed in magnetic separator 70 such as a high extraction magnetic filter containing a magnetizable screen capable of developing a high intensity magnetic field such as a Frantz screen made from thin ribbons of type 430 magnetic stainless steel. Up to 93% of the pyrite and significant amount of ash can be removed to form a final desulfurized, deashed, clean coal containing $<0.7\%$ sulfur.

The recovered CO is available for on-site generation of iron pentacarbonyl by passing CO over a hot bed of iron filings at a temperature of at least 200° C. in iron pentacarbonyl generator 72. CO is separated from the acid gas COS in separator 74 such as one of the Sulfinol process type. The sulfur containing acid gas COS can be recovered as a valuable by-product. The Sulfinol process is based on the absorption of the acidic gas, COS in an organic solvent, Sulfolane (tetrahydrothiophene dioxide) mixed with an alkanolamine usually diisopropanolamine (DIPA) and water. Regeneration is accomplished by release of the acidic gas at elevated temperature and slightly elevated pressure. Details of this process are disclosed at pages 101–102 of the April 1970 issue, page 102 of the April 1973 issue and page 96 of the April 1975 issue of "Hydrocarbon Processing", the disclosures of which are expressly incorporated herein by reference.

Examples of practice follow:

EXAMPLE 1

A slurry of about 30% by weight of a high sulfur bituminous powdered (−200 mesh) coal from Hillsboro, Illinois in benzene containing 10% iron pentacarbonyl was heated in a stirred glass reactor at 75° C. with reflux and 1 atmosphere pressure for 6 hours. The treated slurry was then packed in a stainless steel cylinder and heated at 160° C. for 4 hours to decompose any unreacted iron pentacarbonyl. The resultant slurry was filtered and the coal dried. The final treated coal was analyzed for sulfur forms and the data is presented in Table I.

TABLE I

| Sulfur Form | Raw Coal (% sulfur) | Treated Coal (% sulfur) | Organic Sulfur Removal |
|---|---|---|---|
| Pyritic | 1.89 | 1.47 | |
| Organic | 2.38 | 0.49 | 80% |
| Sulfate | 0.50 | 0.57 | |
| Total | 4.77 | 2.53 | |

The original sulfur content of the coal consisted of 2.38% organic, 1.89% pyritic and 0.5% sulfate sulfur. These results show 80% removal of the organic sulfur. According to the literature, sulfur will be removed as gaseous COS and solid iron-sulfur compounds. So in this experiment, sulfur is assumed to be removed as COS. Due to toxicity problems the gas and liquid samples were not analyzed in these preliminary experiments.

EXAMPLE 2

Example 1 was repeated except that the solvent was toluene, the iron pentacarbonyl was present at 40% by weight and the reaction temperature was 100° C. The sulfur data follows in Table II.

TABLE II

| Sulfur Form | Raw Coal (% Sulfur) | Treated Coal (% Sulfur) | Organic Sulfur Removal |
|---|---|---|---|
| Pyritic | 1.89 | 3.11 | |
| Organic | 2.38 | 0.86 | 64% |
| Sulfate | 0.50 | 0.32 | |
| Total | 4.77 | 4.29 | |

Approximately 64% organic sulfur removal was achieved under these conditions. It is believed that at 100° C. and with excess $Fe(CO)_5$, organic sulfur is converted mainly to pyritic sulfur and partly to COS, though a high degree of organic sulfur conversion and removal was achieved by this method.

Based on the experimental results of Tables I and II on organic sulfur removal and the magnetic process for ash and inorganic sulfur removal, a combined process for coal beneficiation as described in FIG. 2 can be practiced. This relatively simple coal pretreatment process under mild operating conditions will translate into a low cost process. Safety measures have to be taken to handle highly-toxic iron pentacarbonyl. However, iron pentacarbonyl has been safely used in the manufacture of powdered iron cores for high frequency coils, used in the radio and television industry, antiknock agent in motor fuels and as a catalyst in organic reactions.

Thus the process of the invention with an optional combination of the magnetic separation method, which is under investigated in the literature, has a great potential to beneficiate most of the high sulfur and high ash coals in this country to environmentally-acceptable clean fuel.

It is to be realized that only preferred embodiments of the invention have been described and that numerous substitutions, modifications and alterations are permissible without departing from the spirit and scope of the invention as defined in the following claims.

What is claimed is:

1. A method of removing organic bound sulfur from organic carbonaceous material comprising the steps of:

suspending the material in an organic solvent containing excess iron pentacarbonyl with respect to bound sulfur;

heating the suspension to a temperature of at least 40° C. but below 160° C. for a time sufficient to react with at least 50% of the organic bound sulfur; and recovering a desulfurized material from the suspension containing at least 50% less organic bound sulfur.

2. A method according to claim 1 in which the material is particulate high sulfur coal.

3. A method according to claim 2 in which the coal contains at least 1% organic bound sulfur and the coal particles range in size from 60 to 325 mesh.

4. A method according to claim 2 in which the solvent is an aromatic hydrocarbon having a boiling point from 40° C. to below 150° C.

5. A method according to claim 4 in which the solvent is selected from benzene, toluene or anthracene oils.

6. A method according to claim 4 in which the coal is present in the slurry in an amount from 10% to 50% by weight and at least 3% by weight of the iron pentacarbonyl is present in the solution.

7. A method according to claim 6 in which the iron pentacarbonyl is present from 10% to 50% by weight.

8. A method according to claim 2 further including the step of recovery and recycling the solvent.

9. A method according to claim 8 in which the treated suspension is heated to a temperature of at least 160° C. to decompose the iron pentacarbonyl into CO and magnetic iron.

10. A method according to claim 9 further including the step of passing the CO over hot iron filings to generate iron pentacarbonyl.

11. A coal desulfurization system including in combination:

a reactor having a first coal inlet, a second solvent inlet and a third iron pentacarbonyl inlet for forming a slurry of coal in an organic solvent solution of iron pentacarbonyl, having gas outlet means for venting a mixture of CO and COS gases from the reactor and having a slurry outlet;

a distillation column connected to a reboiler for receiving said slurry and heating it to a temperature of at least 160° C. and having a treated slurry outlet, a solvent recycle outlet connected to said second inlet and a CO gas outlet;

gas separator means for receiving the flow from both said gas outlets and for forming a COS by-product stream and a CO stream outlet;

iron pentacarbonyl generation means containing a bed of iron filings and including means for heating said bed, said generation means having a gas inlet connected to the CO stream outlet for generating iron pentacarbonyl and having an iron pentacarbonyl outlet; and conduit means connecting the generation means outlet to the third inlet.

* * * * *